United States Patent [19]

Davis, Jr.

[11] 4,014,256

[45] Mar. 29, 1977

[54] CAN CRUSHER DELIVERY MECHANISM

[76] Inventor: Charles McRea Davis, Jr., 5209 Nannette St., Bonita, Calif. 92002

[22] Filed: Mar. 26, 1976

[21] Appl. No.: 671,018

[52] U.S. Cl. ..... 100/159; 100/DIG. 2; 100/173; 100/176; 100/211; 241/60; 302/2 R

[51] Int. Cl.[2] ..... B30B 3/04

[58] Field of Search ..... 100/DIG. 2, 211, 218, 100/176, 159, 173; 241/60; 302/2 R

[56] References Cited

UNITED STATES PATENTS

| | | | |
|---|---|---|---|
| 3,004,721 | 10/1961 | Notzold | 241/60 X |
| 3,061,206 | 10/1962 | Matter | 241/60 |
| 3,095,806 | 7/1963 | Mirkovich | 100/173 |
| 3,603,122 | 9/1971 | Sulzmann | 100/211 |
| 3,749,004 | 7/1973 | Pagdin | 100/176 X |
| 3,814,009 | 6/1974 | Davis | 100/159 |

*Primary Examiner*—Billy J. Wilhite
*Attorney, Agent, or Firm*—Brown & Martin

[57] ABSTRACT

A can crusher having a pair of horizontally aligned wheels that are in contact in rotational movement, and that receive and crush cans passing therebetween, and which wheels discharge the cans at a high velocity that causes the cans to pass into a horizontally arranged tube that intersects with an upwardly angled tube that carries air under pressure. The air under pressure and the velocity movement of the cans moves the cans upwardly in the angled tube to a container.

5 Claims, 4 Drawing Figures

CAN CRUSHER DELIVERY MECHANISM

BACKGROUND OF THE INVENTION

In collecting cans for reprocessing of the metal therein, it is necessary that the cans be crushed and efficiently deposited into large containers. The crushing of cans can be efficiently processed by the rotation of wheels that are held in alignment. These wheels discharge the cans at a relatively high velocity. However, the cans in being discharged by the intersecting rotating wheels move in a direction of the plane of the wheels. This can create problems as the wheels are normally located in a horizontal alignment at a location relatively close to the ground. The rotating wheels are so located to receive cans from a hopper that is also positioned relatively close to the ground, so the hopper does not require a conveyor to lift the cans from the ground into the hopper. Thus, the cans being discharged by the rotating wheels move in a horizontal direction relatively close to the surface of the ground. However, it is advantageous to use the velocity of the cans as they leave the rotating crushing wheels to move the cans into a container that has enclosing sides that project above the level of the rotating wheels.

It is therefore advantageous to have a simplified and inexpensive means of moving crushed cans from a lower level to an upper level for discharge into a waiting container, that utilizes the velocity of the movement of the cans that is acquired in the crushing process.

SUMMARY OF THE INVENTION

In an exemplary embodiment of this invention, a pair of wheels are oriented horizontally with their respective outer surfaces touching. The wheels are supported on axles in a frame. One of the wheels is rotated and through contact with the other wheel, rotates the other wheel. Cans are inserted into a receiving hopper that is located close to the ground, as are the wheels. The hopper collects the cans and moves the cans by gravity into the intersection of the wheels, where the wheels rotate and pull the cans therethrough crushing the cans in the process, and discharging the cans at a relatively high velocity in a horizontal direction. This height of movement of the cans is below that of the upper opening of a suitable container for receiving the cans.

A first tube is positioned in alignment with the discharge of the rotating tires, for receiving the moving, crushed cans. An upward directed tube intersects with the discharge end of the first tube, wherein the cans in their velocity movement enter into the upwardly angled second tube and move up the tube. The lower end of the upper tube is connected to an air blower that provides volumes of air under pressure that passes through the second tube, providing a further carrying force for moving the cans up through the tube to point of discharge.

The can crusher has a base plate that carries a frame for supporting the frame that holds the wheels, and also supports the blower and the lower end of the upwardly inclined second tube. The second tube supports the end of the first tube, providing an efficient packaged can crusher for crushing cans received from an easily accessed hopper, and moving the cans upwardly to a sufficient height to be deposited into a raised container.

It is therefore an object of this invention to provide a new and improved and efficient can crusher, that crushes cans at one level, and yet moves these crushed cans in one continuous high velocity movement from the can crusher through a circuit to a raised in height opening of a container.

Other objects and many attendant advantages of this invention will become more apparent upon a reading of the following detailed description and an examination of the drawing, wherein like reference numerals designate like parts throughout and in which.

Figure 1:
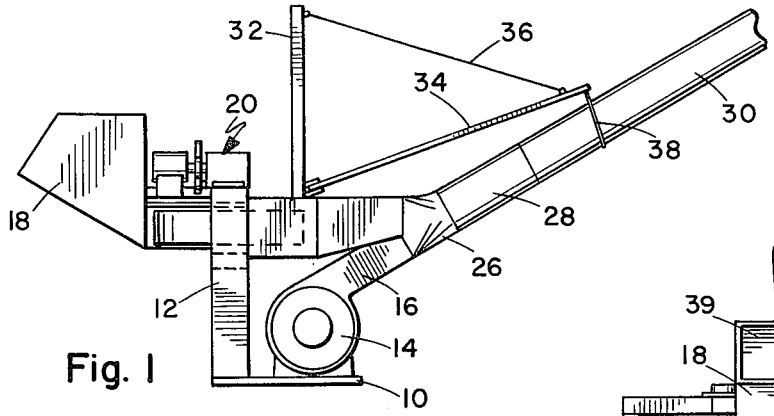
FIG. 1 is a side elevation view of the can crusher apparatus.
Figure 2:
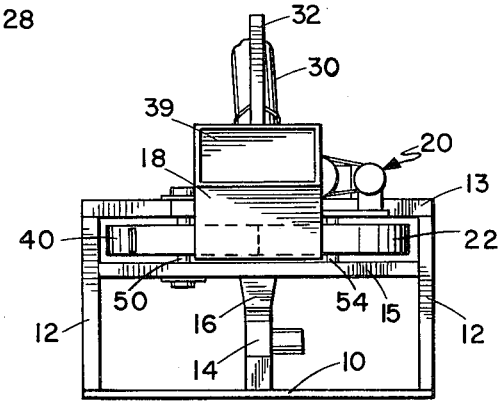
FIG. 2 is a view taken from the left hand side of FIG. 1.
Figure 3:
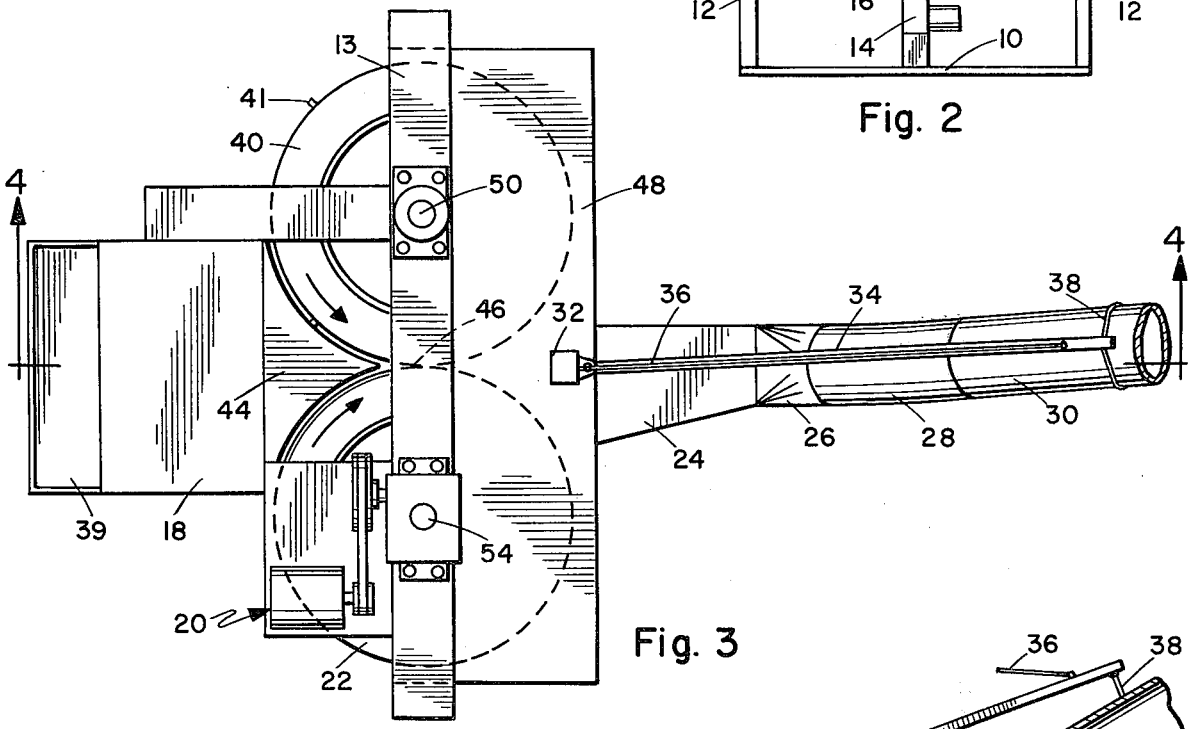
FIG. 3 is an enlarged top plan view of the can crusher apparatus.
Figure 4:
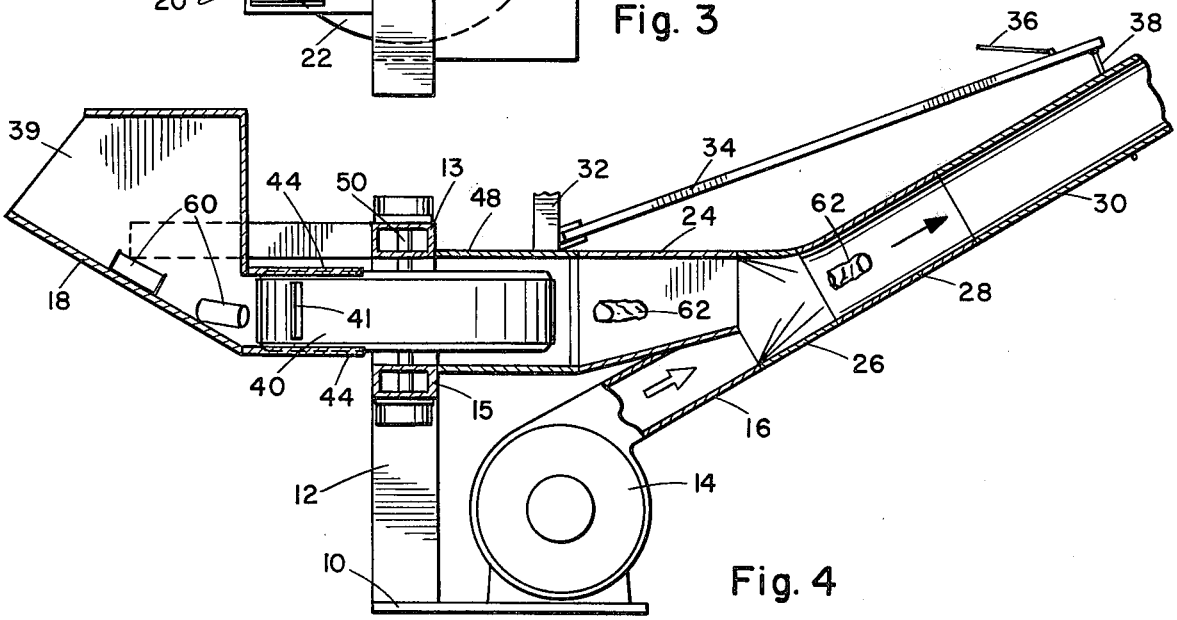
FIG. 4 is a sectional view taken on line 4—4 of FIG. 3.

Referring now to the drawing, the can crusher has a base plate 10. Plate 10 may be made of steel or other suitable material. If desired, plate 10 may be supported by wheels or the like (not shown). Mounted on base plate 10 is a frame 12 that has vertical side members that support a top support member 13 and an intermediate member 15. An axle member 50 is positioned between plate members 13 and 15, and rotationally supports a wheel 40 that is non-resilient and has bar members 41 on its outer circumferential surface. Axle 54 is also supported between members 13 and 15 on which a wheel 22 is rotated that carried a resilient tire. A suitable drive mechanism 20, in this embodiment an electric motor driving a suitable gear mechanism through a pulley belt drive system, rotates the wheel and tire 22. The respective wheels 22 and 40 are so positioned on the frame members and on their respective axles that they contact at an intersection 46.

An enclosed housing 48 is connected to an enclosed hopper 18. Hopper 18 has an opening 39 through which cans 60 are moved in volume. The cans slide down the hopper and enter into the intersection 46 of the wheels 22 and 40. The upper and lower surface of this intersection is protected by plates 44. As the wheels rotate and bar members 41 move through the intersection 46, the cans are driven through the compacting space between the wheels and are crushed. Since the wheels are rotating at a relatively rapid speed, the crushed cans 62 are discharged in a horizontal direction with a high velocity. A short tube section 24 is connected to housing 48 in line to receive the moving crushed cans 62.

The base plate 10 supports a blower 14 that supplies air to an upwardly directed second tube having sections 16, 26, 28 and 30. The second tube is inclined relative to the short first tube 24, and with the horizontal. The tubes intersect at the intersecting chamber 26. Tube section 30 is supported by a boom 34 that is held in support positioned by cable 36 that is connected to the top of a post 32. Lanyard 38 encircles tube 30 forming a support. Tube section 28 may have any desired shape and may also be bendable to provide increased access to selective receptacles for the cans (not shown).

In operation, the cans are inserted through opening 39 into the hopper 18. The cans 60 are moved through the respective wheels 22 and 40, where the cans are crushed and discharged at a high velocity, which cans then move upwardly in the direction of the arrow through tube sections 26, 28 and 30. The air volume provided under pressure by blower 14 moves in the direction of the arrow through tube 16 to pick up the cans 62 and further carry the cans through the discharge tube 30 into the waiting receptacle.

Thus the cans are received at a relatively close position to ground surface, facilitating easy access to opening 39 of hopper 18, and then are crushed and moved through a discharge member to a greater height to a raised receptacle.

Having described my invention, I now claim.

1. A can crusher comprising:

a pair of wheels with at least one wheel having a resilient tire, frame means for holding said wheels rotatably in horizontal orientation and in abutting alignment for rotational contact, means for rotating at least one of said wheels, hopper means for receiving cans and positioning the cans to be moved into the intersecting contact of said wheels to be crushed in passage between said wheels, a tube being aligned with the intersecting contact of said wheels, on the discharge side thereof, for receiving crushed cans, a second tube being angled upwardly, and joining the open end of the first tube, whereby said cans, being discharged at a high velocity from said intersecting wheels move upwardly in said second tube, blower means for providing air under pressure, the lower end of said second tube, being connected to said blower whereby air passes upwardly through said second tube for contacting cans moving at a velocity up said tube, for moving the cans through said second tube to a point of discharge.

2. A can crusher as claimed in claim 1 wherein:

said first tube and second tube intersect at an acute angle.

3. A can crusher as claimed in claim 2 wherein:

said first tube and said second tubes, at the point of intersection, having substantially the same volume.

4. A can crusher as claimed in claim 3 wherein, one of said wheels is non-resilient, and said non-resilient wheel having cross bar means on its outer surface for being contacted and being rotated by contact with the resilient tire of the other wheel.

5. A can crusher as claimed in claim 3 and including:

a base plate member, said frame means being secured to said base plate member, and means for securing said blower to said base plate.

* * * * *